US008262077B2

(12) United States Patent
Yamauchi

(10) Patent No.: US 8,262,077 B2
(45) Date of Patent: Sep. 11, 2012

(54) IMAGE FORMING APPARATUS AND SHEET SUPPLY APPARATUS HAVING PLURALITY OF SHEET SUPPLY UNITS

(75) Inventor: Manabu Yamauchi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 11 days.

(21) Appl. No.: 13/006,882

(22) Filed: Jan. 14, 2011

(65) Prior Publication Data

US 2011/0175276 A1 Jul. 21, 2011

(30) Foreign Application Priority Data

Jan. 21, 2010 (JP) ..... 2010-011122

(51) Int. Cl.
*B65H 3/44* (2006.01)
*B65H 3/14* (2006.01)

(52) U.S. Cl. ..... 271/9.02; 271/9.04; 271/98; 271/97; 271/105

(58) Field of Classification Search ..... 271/9.02, 271/9.04, 97, 98, 105
See application file for complete search history.

(56) References Cited

U.S. PATENT DOCUMENTS

2009/0066008 A1* 3/2009 Hirose et al. ..... 271/9.01

FOREIGN PATENT DOCUMENTS

JP 2005-162419 A 6/2005

* cited by examiner

*Primary Examiner* — Luis A Gonzalez
(74) *Attorney, Agent, or Firm* — Rossi, Kimms & McDowell LLP

(57) ABSTRACT

An image forming apparatus which can prevent decrease in useful lives of components for air sheet feeding without bringing about throughput degradation when performing an image forming operation using a plurality of sheet supply units. When a sheet is fed from a first sheet supply unit having a fan that is driven so as to supply sheets, then a sheet is supplied from a second sheet supply unit, and then a sheet is supplied form the first sheet supply unit again, and in a case where a suspension time period over which no sheet is supplied from the first sheet supply unit is longer than a preparation time period from when driving of the fan is started to when the fan is brought into a driving state required to supply a sheet, driving of the fan is temporarily stopped.

11 Claims, 11 Drawing Sheets

FIG.5A

| | | SHEET FEEDING CASSETTE | | | |
|---|---|---|---|---|---|
| | | 1 | 2 | 3 | 4 |
| | | A4 | A4 | B4 | A3 |
| PAGE | 1 | — | — | — | ○ |

FIG.5B

| | | SHEET FEEDING CASSETTE | | | |
|---|---|---|---|---|---|
| | | 1 | 2 | 3 | 4 |
| | | A4 | A4 | B4 | A3 |
| PAGE | 1 | — | — | — | ○ |
| | 2 | — | — | — | ○ |
| | 3 | — | — | — | ○ |

FIG.5C

| | | | SHEET FEEDING CASSETTE | | | | |
|---|---|---|---|---|---|---|---|
| | | | 1 | 2 | 3 | 4 | |
| | | | A4 | A4 | B4 | A3 | |
| FIRST COPY SET | PAGE | 1 | — | — | — | ○ | |
| | | 2 | — | — | — | ○ | |
| | | 3 | — | — | — | ○ | |
| | | 4 | ○ | — | — | — | |
| | | 5 | ○ | — | — | — | ← LAST PAGE DETERMINED |

FIG.6A

| SHEET FEEDING ORDER | | SHEET FEEDING CASSETTE | |
|---|---|---|---|
| | | 1 | 4 |
| | | A4 | A3 |
| FIRST COPY SET | 1 | – | ○ |
| | 2 | – | ○ |
| | 3 | – | ○ |
| | 4 | ○ | – |
| | 5 | ○ | – |
| SECOND COPY SET | 6 | – | ○ |
| | 7 | – | ○ |
| | 8 | – | ○ |
| | 9 | ○ | – |
| | 10 | ○ | – |
| THIRD COPY SET | 11 | – | ○ |
| | 12 | – | ○ |
| | 13 | – | ○ |
| | 14 | ○ | – |
| | 15 | ○ | – |
| FOURTH COPY SET | 16 | – | ○ |
| | 17 | – | ○ |
| | 18 | – | ○ |
| | 19 | ○ | – |
| | 20 | ○ | – |

FIG.6B

| SIZE | TIME |
|---|---|
| A4 | 2 SECONDS |
| A3 | 4 SECONDS |

FIG.6C

| SHEET FEEDING ORDER | | SHEET FEEDING CASSETTE 1 A4 | SHEET FEEDING CASSETTE 4 A3 |
|---|---|---|---|
| FIRST COPY SET | 1 | – | ○ 4 |
| | 2 | – | ○ 4 |
| | 3 | – | ○ 4 |
| | 4 | ○ 2 | – |
| | 5 | ○ 2 | – |
| SECOND COPY SET | 6 | – | ○ 4 |
| | 7 | – | ○ 4 |
| | 8 | – | ○ 4 |
| | 9 | ○ 2 | – |
| | 10 | ○ 2 | – |
| THIRD COPY SET | 11 | – | ○ 4 |
| | 12 | – | ○ 4 |
| | 13 | – | ○ 4 |
| | 14 | ○ 2 | – |
| | 15 | ○ 2 | – |
| FOURTH COPY SET | 16 | – | ○ 4 |
| | 17 | – | ○ 4 |
| | 18 | – | ○ 4 |
| | 19 | ○ 2 | – |
| | 20 | ○ 2 | – |

FIG.6D

| SHEET FEEDING ORDER | | SHEET FEEDING CASSETTE 1 A4 | SHEET FEEDING CASSETTE 4 A3 |
|---|---|---|---|
| FIRST COPY SET | 1 | – | ○ 4 |
| | 2 | – | ○ 4 |
| | 3 | – | ○ 4 |
| | 4 | ○ 2 | – |
| | 5 | ○ 14 | – |
| SECOND COPY SET | 6 | | ○ 4 |
| | 7 | | ○ 4 |
| | 8 | | ○ 8 |
| | 9 | ○ 2 | |
| | 10 | ○ 14 | |
| THIRD COPY SET | 11 | | ○ 4 |
| | 12 | | ○ 4 |
| | 13 | | ○ 8 |
| | 14 | ○ 2 | |
| | 15 | ○ 14 | |
| FOURTH COPY SET | 16 | | ○ 4 |
| | 17 | | ○ 4 |
| | 18 | | ○ END |
| | 19 | ○ 2 | |
| | 20 | ○ END | |

IMAGE FORMING APPARATUS AND SHEET SUPPLY APPARATUS HAVING PLURALITY OF SHEET SUPPLY UNITS

BACKGROUND OF THE INVENTION

1. Field of the Invention

The present invention relates to an image forming apparatus and a sheet supply apparatus having a plurality of sheet supply units.

2. Description of the Related Art

Conventionally, an image forming apparatus such as a copier, a printer, or a facsimile machine has a sheet storage unit (sheet feeding cassettes) in which recording sheets are stored, feeds a recording sheet from the sheet storage unit using a sheet feeding unit, and conveys the recording sheet to an image forming unit. The image forming apparatus then forms an image on the recording sheet, and discharges the recording sheet from the image forming apparatus.

As an example of the sheet feeding apparatus, an air sheet feeding apparatus adopting an air separation method has been proposed (see Japanese Laid-Open Patent Publication (Kokai) No. 2005-162419). This air sheet feeding apparatus is comprised of a sheet stacking unit on which sheets are stacked, a sheet loosening unit that loosens upper sheets by blowing air to ends of the sheets stacked on the sheet stacking unit, a conveying belt, and an attracting conveying unit that attracts an uppermost sheet to the conveying belt and conveys the same.

The air sheet feeding apparatus requires a time period from when driving of a fan is started to when sheets are ready to be fed, because air is blown. To reduce the time period required for sheet feeding in a case where sheets are fed selectively from a plurality of sheet feeding cassettes, the fan should be left driven, but in this case, the useful life of the fan is decreased due to increased power consumption. On the other hand, when driving of the fan is stopped after sheet feeding from one sheet feeding cassette completes, it takes time to feed a sheet from that sheet feeding cassette again, resulting in the productivity of the image forming apparatus decreasing.

SUMMARY OF THE INVENTION

The present invention provides an image forming apparatus and a sheet supply apparatus which prevent decrease in useful lives of components for air sheet feeding without bringing about throughput degradation when performing an image forming operation using a plurality of sheet supply units.

Accordingly, a first aspect of the present invention provides an image forming apparatus comprising an image forming unit configured to form an image on a sheet, a first sheet supply unit configured to store a plurality of sheets, supply the sheets one by one to the image forming unit, and have a fan that is driven so as to supply the sheets, a second sheet supply unit configured to store a plurality of sheets, and supply the sheets one by one to the image forming unit, and a control unit configured to, when a sheet is fed from the first sheet supply unit, then a sheet is supplied from the second sheet supply unit, and then a sheet is supplied form the first sheet supply unit again, in a case where a suspension time period over which no sheet is supplied from the first sheet supply unit is longer than a preparation time period from when driving of the fan is started to when the fan is brought into a driving state required to supply a sheet, temporarily stop driving of the fan in the suspension time period.

Accordingly, a second aspect of the present invention provides a sheet feeding apparatus that supplies a sheet to an image forming apparatus that forms an image on a sheet, a first sheet supply unit configured to store a plurality of sheets, supply the sheets one by one to an image forming unit, and have a fan that is driven so as to supply the sheets, a second sheet supply unit configured to store a plurality of sheets, and supply the sheets one by one to the image forming unit, and a control unit configured to, when a sheet is supplied from the first sheet supply unit, then a sheet is supplied from the second sheet supply unit, and then a sheet is supplied from the first sheet supply unit again, in a case where a suspension time period over which no sheet is supplied from the first sheet supply unit is longer than a preparation time period from when driving of the fan is started to when the fan is brought into a driving state required to supply a sheet, temporarily stop driving of the fan.

Accordingly, a third aspect of the present invention provides an image forming apparatus comprising an image forming unit configured to form an image on a sheet, a first sheet supply unit configured to store a plurality of sheets, supply the sheets one by one to the image forming unit, and have a fan that is driven so as to supply the sheets, a second sheet supply unit configured to store a plurality of sheets, and supply the sheets one by one to the image forming unit, an obtaining unit configured to obtain a sheet supply order in which sheets are supplied from the first sheet supply unit and the second sheet supply unit, and a control unit configured to control driving and stop of the fan based on the sheet supply order obtained by the obtaining unit, wherein the control unit obtains a time period equivalent to a suspension time period from when supply of a sheet from the first sheet supply unit is stopped to when a sheet is supplied from the first sheet supply unit next, and in a case where the time period equivalent to the suspension time period is longer than a preparation time period from when driving of the fan is started to when the fan is brought into a driving state required to supply a sheet, temporarily stops driving of the fan in the suspension time period, and at a time that goes back the preparation time from a time at which a sheet is supplied from the first sheet supply unit, resumes driving of the fan.

Accordingly, a fourth aspect of the present invention provides a sheet feeding apparatus that supplies a sheet to an image forming apparatus that forms an image on the sheet, comprising a first sheet supply unit configured to store a plurality of sheets, supply the sheets one by one to an image forming unit, and have a fan that is driven so as to supply the sheets, a second sheet supply unit configured to store a plurality of sheets, and supply the sheets one by one to the image forming unit, an obtaining unit configured to obtain a sheet supply order in which sheets are supplied from the first sheet supply unit and the second sheet supply unit, and a control unit configured to control operation and stop of the fan based on the sheet supply order obtained by the obtaining unit, wherein the control unit obtains a time period equivalent to a suspension time period from when supply of a sheet from the first sheet supply unit is stopped to when a sheet is supplied from the first sheet supply unit next, and in a case where the time period equivalent to the suspension time period is longer than a preparation time period from when driving of the fan is started to when the fan is brought into a driving state required to supply a sheet, temporarily stops driving of the fan in the suspension time period, and at a time that goes back the preparation time from a time at which a sheet is supplied from the first sheet supply unit, resumes driving of the fan.

According to the present invention, driving of the fan is suspended when the suspension time period is longer than the preparation time period. Thus, when an image forming operation is performed using a plurality of sheet supply units in one job, for example, in a case where sheets of different sizes are stacked, driving of the fan can be positively stopped without bringing about throughput degradation. As a result, the useful life of the fan can be prevented from decreasing, and noise and power consumption caused by fan drive can be reduced. Also, sheet degradation caused by drying can be prevented.

Further features of the present invention will become apparent from the following description of exemplary embodiments (with reference to the attached drawings).

BRIEF DESCRIPTION OF THE DRAWINGS

FIGS. 5A to 5C are views showing tables that show how a sheet feeding order is determined.

FIGS. 6A to 6D are views showing tables that show how sheet feeding suspension time periods are determined.

DESCRIPTION OF THE EMBODIMENTS

A description will now be given of an embodiment of an image forming apparatus and a sheet supply apparatus according to the present invention with reference to the drawings.

Figure 1:
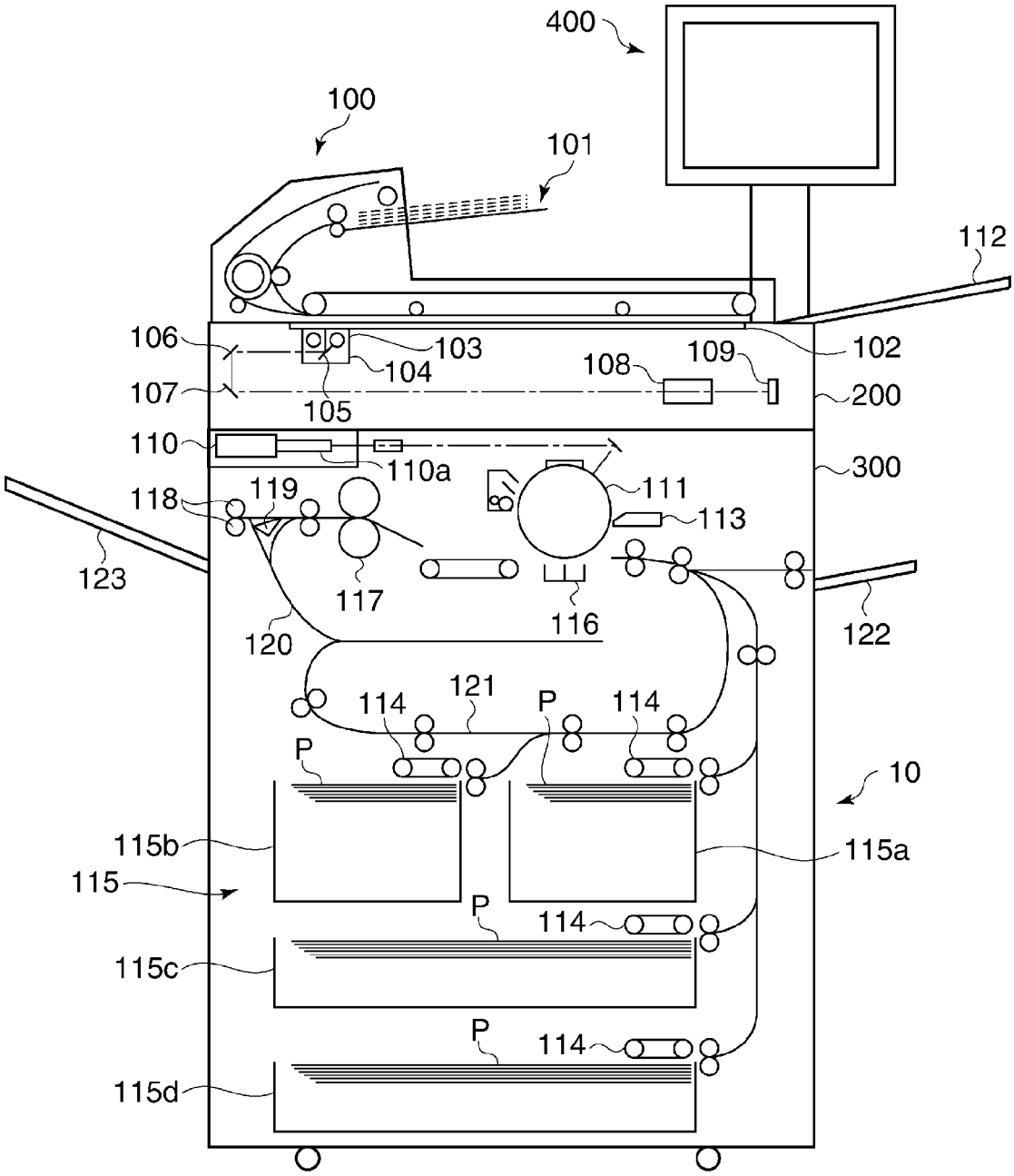
FIG. 1 is a longitudinal sectional view schematically showing an overall arrangement of an image forming apparatus according to an embodiment of the present invention.

FIG. 1 is a longitudinal sectional view schematically showing an overall arrangement of the image forming apparatus according to the embodiment. The image forming apparatus 10 has an image forming apparatus main body comprised mainly of an image reader 200, which reads original images, and a printer 300.

The image reader 200 is equipped with an original feeder 100. The original feeder 100 sequentially feeds originals, which are placed facing upward on an original tray 101 on which originals can be mounted, one by one from the first page toward the left as viewed in the figure, and conveys each original to a platen glass 102 via a curved path. Further, the original feeder 100 conveys the original from the left to the right as viewed in the figure via a moving reading position on the platen glass 102, and then discharges the original toward an external discharged sheet tray 112.

When the original passes through the moving reading position on the platen glass 102 from the left to the right, an image on the original is read by a scanner unit 104 held at a position corresponding to the moving reading position. This reading method is generally referred to as a moving original reading method.

Specifically, when the original passes through the moving reading position, a surface of the original to be read is irradiated by light from a lamp 103 of the scanner unit 104. Reflected light from the original is guided to a lens 108 via mirrors 105, 106, and 107. Further, the light having passed through the lens 108 forms an image on an imaging area of an image sensor 109. Image data output from the image sensor 109 is subjected to a predetermined process by an image signal controller 622 (see FIG. 2), described later, and input as a video signal to an exposure controller 110 in the printer 300.

The exposure controller 110 in the printer 300 modulates and outputs a laser beam based on the input video signal. The laser beam is irradiated onto a photosensitive drum 111 while being scanned by a polygon mirror 110*a*. An electrostatic latent image corresponding to the scanned laser beam is formed on the photosensitive drum 111. When stationary original reading is to be performed, the exposure controller 110 outputs the laser beam so that an erect image (an image that is not reversed) can be formed as described later. The electrostatic latent image formed on the photosensitive drum 111 is visualized as a developer image by a developer supplied from a developing unit 113.

Also, in synchronization with the start of irradiation of the laser beam, a sheet is fed from any of cassettes 115, a manual sheet feeding unit 122, or a double-sided conveying path 121, and the sheet is conveyed to an area between the photosensitive drum 111 and a transfer unit 116. It should be noted that in the present embodiment, as sheet storages (cassettes), there are provided cassettes 115*a* and 115*b* for A4-size sheets, a cassette 115*c* for B4-size sheets, and a cassette 115*d* for A3-size sheets. When it is unnecessary to make a distinction between these cassettes, they are collectively referred to as the cassette 115.

The developer image formed on the photosensitive drum 111 is transferred to the fed sheet by the transfer unit 116. The sheet bearing the transferred developer image is conveyed to a fixing unit 117. The fixing unit 117 fixes the developer image on the sheet by heating and pressurizing the sheet. The sheet having passed through the fixing unit 117 passes through a flapper 119 and discharging rollers 118, and is then discharged from the printer 300 toward an external discharged sheet tray 123.

Here, when the sheet is discharged with its image bearing surface facing downward (face-down), the image forming apparatus drives the flapper 119 to perform a switching action, and thus temporarily guides the sheet having passed through the fixing unit 117 into a reversing path 120. Further, after a trailing end of the sheet passes by the flapper 119, the image forming apparatus switches the sheet back, and causes the discharging rollers 118 to discharge the sheet from the printer 300 toward the external discharged sheet tray 123. This sheet discharging mode is referred to as reversed sheet discharging. The reversed sheet discharging is performed when images are sequentially formed from the first page, for example, in a case where images read using the original feeder 100 are formed, or in a case where images output from a computer are formed. After being discharged, the sheets are in a correct page order.

Further, a setting is made to perform double-sided recording in which images are formed on both sides of a sheet, the image forming apparatus guides the sheet into the reversing path 120 by driving the flapper 119 to perform a switching action, and then conveys the sheet to the double-sided conveying path 121. Further, the image forming apparatus performs control to feed the sheet guided to the double-sided conveying path 121 to the area between the photosensitive drum 111 and the transfer unit 116 again.

Figure 2:
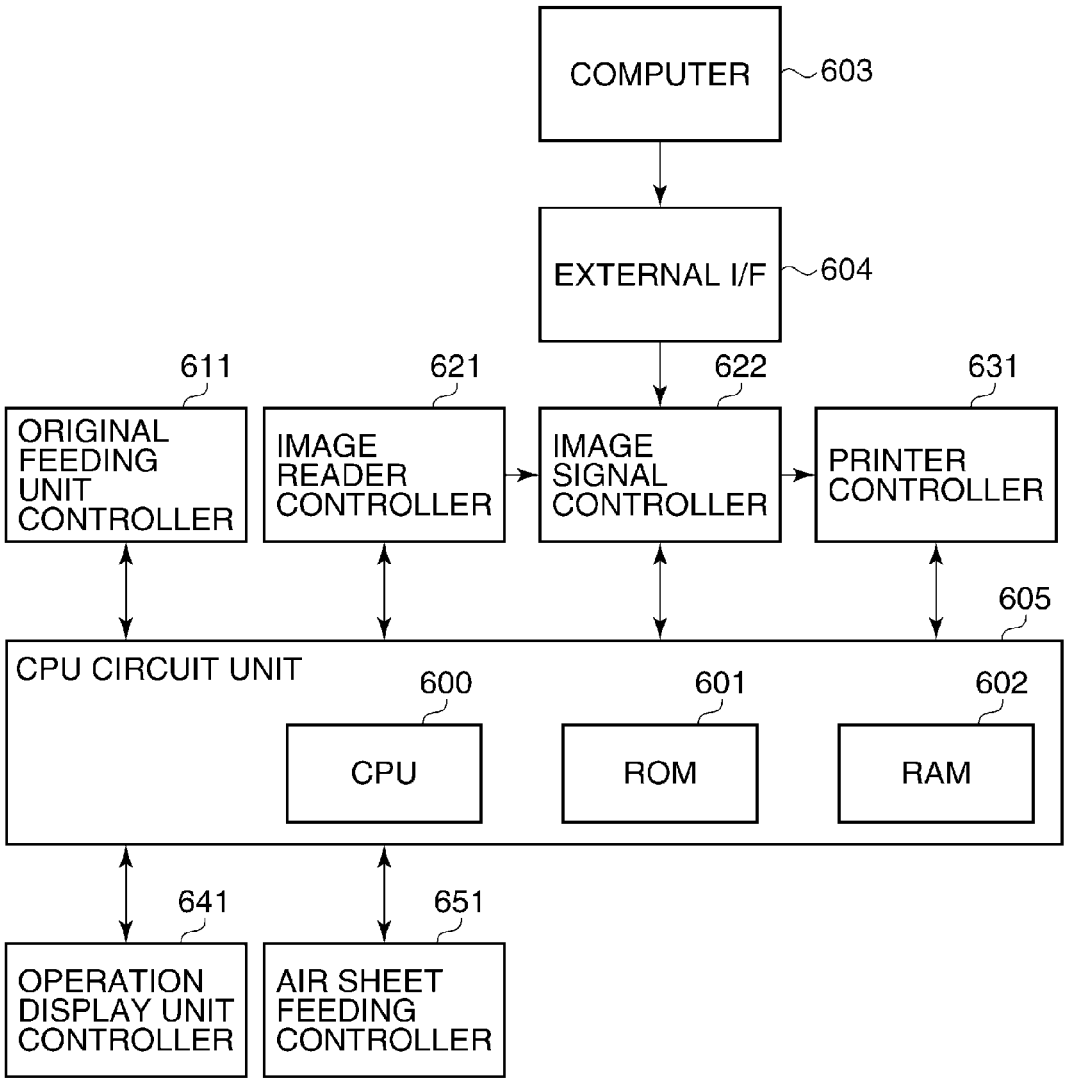
FIG. 2 is a block diagram schematically showing an arrangement of a controller that controls the overall operation of the image forming apparatus.

A description will now be given of an arrangement of a controller that plays a pivotal role in controlling the overall operation of the image forming apparatus. FIG. 2 is a block diagram schematically showing the arrangement of the controller that plays a pivotal role in controlling the overall operation of the image forming apparatus. The controller has a CPU circuit unit 605. An original feeder controller 611, an image reader controller 621, the image signal controller 622, a printer controller 631, an operation display unit controller 641, and an air sheet feeding controller 651 are connected to the CPU circuit unit 605. An external interface (I/F) 604 connected to a computer 603 is connected to the image signal controller 622.

The CPU circuit unit 605 has a CPU 600, a ROM 601, and a RAM 602 incorporated therein. The CPU circuit unit 605 controls blocks by the CPU 600 executing control programs stored in the ROM 601. Namely, the CPU circuit unit 605 collectively controls the original feeder controller 611, the image reader controller 621, the image signal controller 622, the printer controller 631, the operation display unit controller 641, and the air sheet feeding controller 651.

The RAM 602 temporarily stores control data, and is used as a work area for arithmetic processes. The CPU 600 performs computations and input-output control required to control the image forming apparatus 10.

The original feeder controller 611 controls the original feeder 100 in accordance with instructions from the CPU circuit unit 605. The image reader controller 621 controls the operation of the scanner unit 104, the image sensor 109, and so on, and transfers an analog image signal output from the image sensor 109 to the image signal controller 622.

The image signal controller 622 converts the analog image signal from the image sensor 109 to a digital signal, subjects the digital signal to various processes, converts the digital signal subjected to the processes to a video signal, and outputs the video signal to the printer controller 631. Also, the image signal controller 622 subjects a digital image signal input from the computer 603 via the external I/F 604 to various processes, converts the digital image signal subjected to the processes to a video signal, and outputs the video signal to the printer controller 631. The operation of the image signal controller 622 is controlled by the CPU circuit unit 605. It should be noted that images on originals read by the image reader 200 and images sent from the computer 603 are stored in an image memory, not shown.

The printer controller 631 drives the exposure control unit 110 based on the input video signal. The air sheet feeding controller 651 controls sheet feeding in accordance with instructions from the CPU circuit unit 605.

The operation display unit controller 641 exchange information between the operation display unit 400 and the CPU circuit unit 605. The operation display unit 400 has a plurality of keys for setting various functions relating to image formation, a display for displaying information on setting states, and so on. The operation display unit 400 outputs key signals corresponding to operations of the keys to the CPU circuit unit 605, and displays the corresponding information on the display based on signals from the CPU circuit unit 605.

Figure 3:
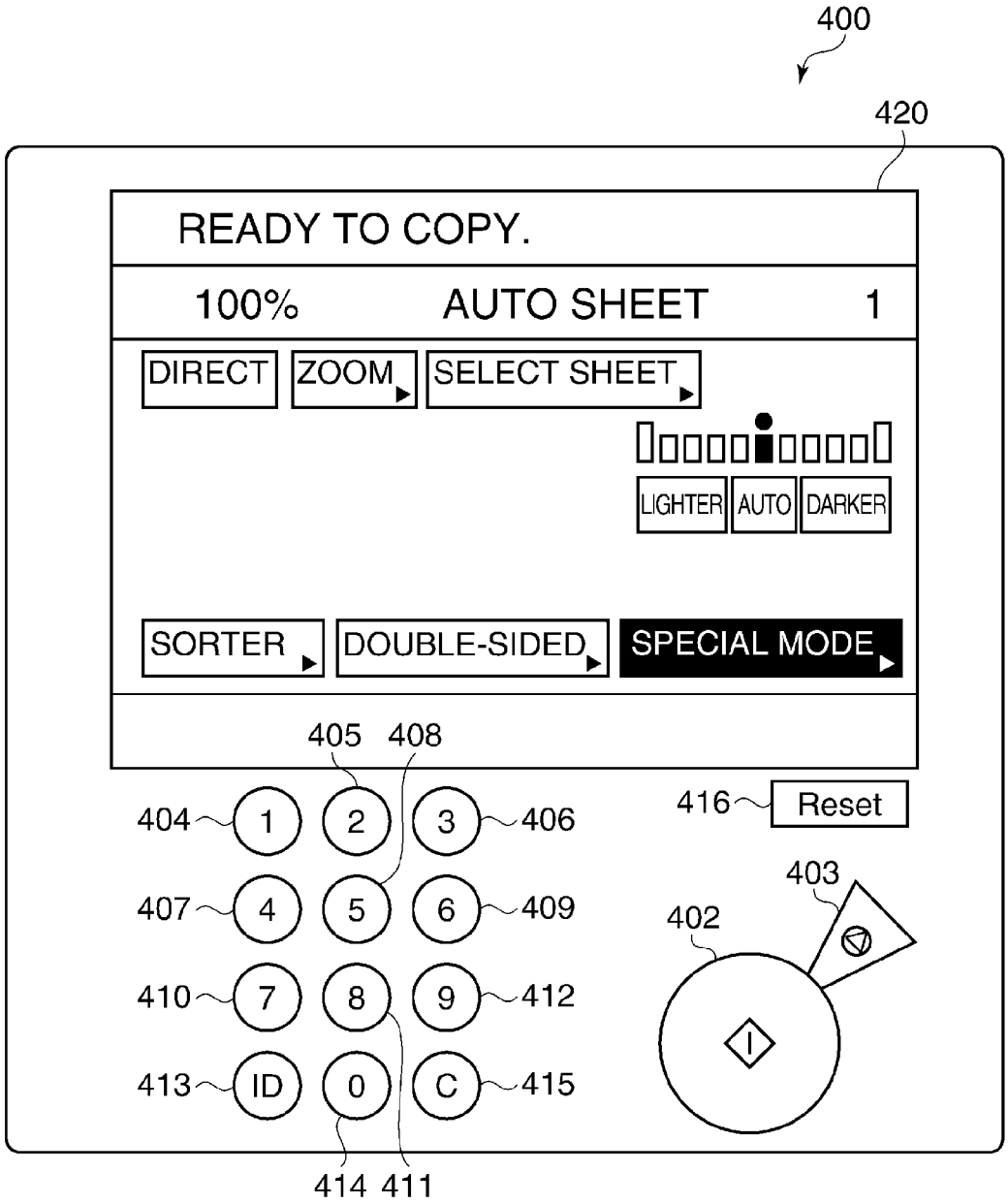
FIG. 3 is a front view showing an appearance of an operation display unit 400.

FIG. 3 is a front view showing an appearance of the operation display unit 400. A start key 402 for starting an image forming operation, a stop key 403 for stopping an image forming operation, and numeric keys 404 to 412 and 414 for setting number of copies and others are placed on the operation display unit 400. Also, an ID key 413, a clear key 415, a reset key 416, a user mode key 417 for configuring various devices, and so on are placed on the operation display unit 400. Also, a liquid crystal display 420 on which a touch panel is formed is placed in an upper part of the operation display unit 400. Soft keys can be created on the screen of the liquid crystal display 420.

Figure 4:
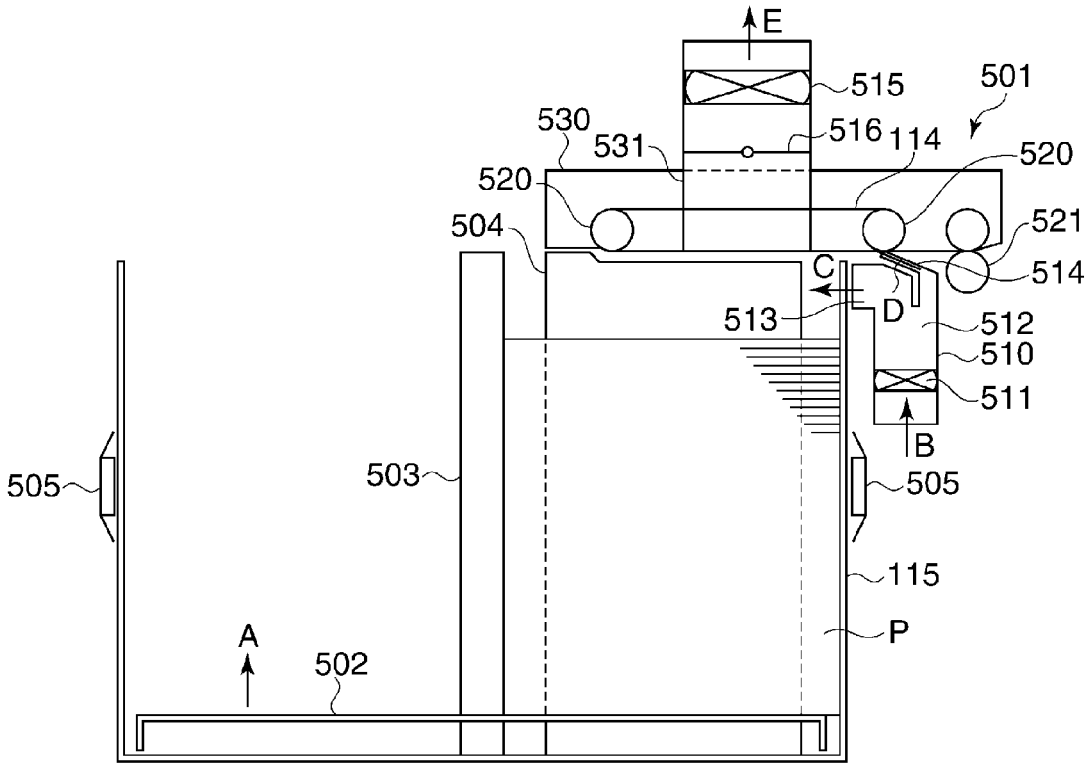
FIG. 4 is a view schematically showing an arrangement of a cassette 115.

FIG. 4 is a view schematically showing an arrangement of the cassette 115. As described above, in the present embodiment, the cassettes 115*a* and 115*b* for A4-size sheets, the cassette 115*c* for B4-size sheets, and the cassette 115*d* for A3-size sheets are provided as sheet storages (cassettes).

The cassette 115 has a tray 502, which is a sheet stacking unit, a rear end restriction plate 503 that restricts positions of sheets P on an upstream side in a sheet feeding direction (a rear side, that is, a left side as viewed in the figure), and a side end restriction plate 504 that restricts positions of the sheets P in a width direction perpendicular to the sheet feeding direction. The rear end restriction plate 503 and the side end restriction plate 504 are configured to be shifted to arbitrary positions according to sizes of the sheets P stored in the cassette 115. The cassette 115 can be pulled out from the printer 300 toward the front as viewed in the figure via slide rails 505.

Further, a sheet feeding mechanism of an air sheet feeding type for feeding the sheets P one by one separately from each other (hereafter referred to as the air sheet feeding mechanism 501) is provided above the cassette 115. Namely, the plurality of cassettes 115*a*, 115*b*, 115*c*, and 115*d* (sheet supply units) for different sizes of sheets are provided with the respective air sheet feeding mechanisms 501. The air sheet feeding mechanism 501 has an attracting feeding unit 530 (an air attraction unit) that attracts and feeds the sheets P stacked on the tray 502, and an air blowing unit 510 (an air jetting unit) that levitates sheets in an upper part of the sheet stack stacked on the tray 502 and separates the sheets P from each other.

The attracting feeding unit 530 has an attracting feeding belt 114 that is looped over belt driving rollers 520, and attracts and feeds the sheet P toward the right as viewed in the figure, and an attracting fan 515 (a second fan) that generates negative pressure so as to attract the sheet P to the attracting feeding belt 114. The attracting feeding unit 530 also has a suction duct 531 that is disposed inside the attracting feeding belt 114 to suck air through a suction hole (not shown) formed in the attracting feeding belt 114. Further, the attracting feeding unit 530 has an attracting shutter 516 and others, and the attracting shutter 516 is disposed between the attracting fan 515 (a suction fan) and the suction duct 531, and activates and inactivates the attracting feeding belt 114 which performs an attracting action. It should be noted that in the present embodiment, a plurality of attracting feeding belts 114 are disposed at predetermined intervals in the width direction.

The air blowing unit 510 has a loosening nozzle 513 and a separation nozzle 514 for blowing air to an upper part of the stored sheets P, a separation fan 511, and a separation duct 512 that sends air from the separation fan 511 (the fan for separation) to the nozzles 513 and 514.

Part of the air sucked in a direction indicated by an arrow B in the figure by the separation fan 511 (a first fan) passes through the separation duct 512, and is blown in a direction indicated by an arrow C in the figure by the loosening nozzle 513 to lift several sheets in an upper part of the sheet stack stacked on the tray 502. The other air is blown in a direction indicated by an arrow D in the figure by the separation nozzle 514 to separate the sheets levitated by the loosening nozzle 513 and attract the sheets to the attracting feeding belt 114.

Next, a description will be given of a sheet feeding operation by the air sheet feeding mechanism 501 arranged as described above.

First, when the user pulls out the cassette 115, places sheets P thereon, and then, as shown in FIG. 4, stores the cassette 115 at a predetermined position, the tray 502 starts rising in a direction indicated by an arrow A. Then, when an upper surface of the sheets P placed on the tray 502 reaches a position at which the attracting feeding belt 114 can feed a sheet, the tray 502 stops at this position.

Thereafter, upon detecting a sheet feeding signal from the printer controller 631, the CPU circuit unit 605 causes the air sheet feeding controller 651 to operate the separation fan 511. The operation of the separation fan 511 sucks air in the direction indicated by the arrow B. The air is blown to the sheet stack from the directions indicated by the arrows C and D in the figure via the separation duct 512, and further, via the loosening nozzle 513 and the separation nozzle 514. This levitates upper several sheets in the sheet stack. Further, the CPU circuit unit 605 causes the air sheet feeding controller 651 to operate the attracting fan 515. The operation of the attracting fan 511 causes the air to be discharged in a direction indicated by an arrow E in the figure. In this stage, the suction shutter 516 is still closed.

When a predetermined time period elapses since the sheet feeding signal is detected, and the lifting of the upper sheets becomes stable, the CPU circuit unit 605 causes the air sheet feeding controller 651 to rotate the attracting shutter 516 and open the suction duct 531. This generates a suction force from the suction hole formed in the attracting feeding belt 114. The suction force and the air from the separation nozzle 514 cause only an uppermost one of the sheets P stacked on the tray 502 to be attracted to the attracting feeding belt 114.

The CPU circuit unit 605 causes the air sheet feeding controller 651 to rotate the belt driving rollers 520. As a result, the uppermost sheet is fed in the state of being attracted to the attracting feeding belt 114, and thereafter, the sheet is fed toward the image forming unit by a pair of drawing rollers 521.

Next, a description will be given of a sheet feeding operation in an example where originals placed on the original feeder 100 are copied. First, the user places originals to be copied on the original feeder 100. Then, the user sets a desired number of copies (a set number of copies) using the numeric keys 404 to 412 in the operation display unit 400, and depresses the start key 402 to start a copying operation. In the copying operation, the scanner unit 104 sequentially reads the originals from the first page as described above. While each original is being conveyed, a size of the original is detected, and a sheet of a size corresponding to the size of the original is fed from any of the cassettes 115. The image reading operation and an image forming operation are performed in parallel. Moreover, until the last original is read, the number of originals cannot be determined. However, once the number of originals has been determined by the image forming operation for the first copy set, the image forming operation is repeated on the same originals a number of times corresponding to the set number of copies, and thus in the second and subsequent image forming operations, a sheet feeding order is determined. It should be noted that in one job, repetition of an image forming operation (sequential image forming operations) is performed a number of times obtained by subtracting a value of 1 from a set number of copies.

A description will now be given of how a sheet feeding sequence (a sheet feeding order) is determined. FIGS. 5A to 5C are views showing tables that show how a sheet feeding order is determined. The table is stored in a sheet feeding order storage region in the RAM 602. When the cassette 115 is requested to feed a sheet, as shown in FIG. 5A, a sheet feeding cassette (a sheet supply unit) requested to feed a sheet is stored in association with a sheet size in the sheet feeding order storage region in the RAM 602. Here, it is stored that for the first page, a sheet feeding cassette 4 (the cassette 115*d*), which is a second sheet supply unit, is requested to feed a sheet. Whenever an original is read by the scanner unit 104, and a sheet feeding request is issued, a sheet feeding order is stored in the above-mentioned storage region as shown in FIG. 5B. Then, until all the originals are read, and the last page is determined, sheet feeding orders are sequentially stored in the above-mentioned storage region as shown in FIG. 5C.

In the present embodiment, one copy set of originals consists of five pages. It is determined that the first to third page sheets are fed from the sheet feeding cassette 4, the fourth to fifth sheets are fed from a sheet feeding cassette 1 (the cassette 115*a*), which is a first sheet supply unit. Then, sheet feeding orders thus determined are stored in the sheet feeding order storage region in the RAM 602.

Next, a description will be given of how a sheet feeding suspension time period is determined. The sheet feeding suspension time period is a time period from when one sheet is fed to when the next sheet is fed in one sheet feeding unit, and includes a time period over which no sheet is fed because sheet feeding is not requested. FIGS. 6A to 6D are views showing a table that shows how the sheet feeding suspension time period is determined. When the number of originals in the first copy set is determined, sheet feeding orders (or image forming orders) for the second and subsequent copies are repetitions according to the set number of copies. Thus, the order in which all the sheets are fed is as shown in FIG. 6A. Here, an image forming operation is performed assuming that the set number of copies is set at 4 copies.

In the table in FIG. 6B, a time period required from when one sheet is fed to when a sheet on which an image for the next page is to be formed is ready to be fed is stored for each sheet size. Here, an image forming apparatus that is capable of forming images on 30 A4-size sheets per minute is given as an example. Thus, as shown in FIG. 6B, in a case where an A4-size sheet is fed, and then a sheet on which an image for the next page is to be formed is fed, a time period required as a sheet feeding interval is 2 seconds. Also, in a case where an A3-size sheet is fed, and then a sheet on which an image for the next page is to be formed is fed, a time period required as a sheet feeding interval is 4 seconds.

Moreover, in the air sheet feeding mechanism 501 according to the present embodiment, a preparation time period T2 as an activation time period from when the separation fan 511 and the attracting fan 515 are driven to when the cassette 115 is ready to feed a sheet is 10 seconds.

As shown in FIGS. 6C and 6D, in a case where after a sheet is fed from the sheet feeding cassette 1 (after a sheet is supplied), a sheet is fed from the sheet feeding cassette 4, and a sheet is fed from the sheet feeding cassette 1 again, the sheet feeding suspension time period in the sheet feeding cassette 1 (A4 size) is 14 seconds from a sheet feeding order 5 to a sheet feeding order 9 in the sheet feeding cassette 1. Similarly, the sheet feeding suspension time period is 14 seconds from a sheet feeding order 10 to a sheet feeding order 14, and from a sheet feeding order 15 to a sheet feeding order 19 is also 14 seconds. The sheet feeding suspension time period is longer than the preparation time period T2 (=10 seconds) from when fan drive is started to when a sheet is ready to be fed.

On the other hand, as shown in FIG. 6D, the sheet feeding suspension time period in the sheet feeding cassette 4 (A3 size) is shorter than the above time period T2 (=10 seconds) at all sheet feeding times.

Assuming that the sheet feeding suspension time period is T1, the sheet feeding suspension time period T1 from the sheet feeding order 5 to the sheet feeding order 9 in the sheet feeding cassette 1 is 14 seconds as described above. Thus, it is determined that fan drive is suspended for 4 seconds, which is a difference between the sheet feeding suspension time period T1 and the preparation time period T2 (T1−T2), after a sheet is fed in the sheet feeding order 5.

However, preparations for feeding a sheet in the sheet feeding order 9 as the next sheet feeding timing (time) require the time period T2 (10 seconds) after fan drive is started. For this reason, control is performed so as to start fan drive again after fan drive is suspended for 4 seconds.

Figure 7:
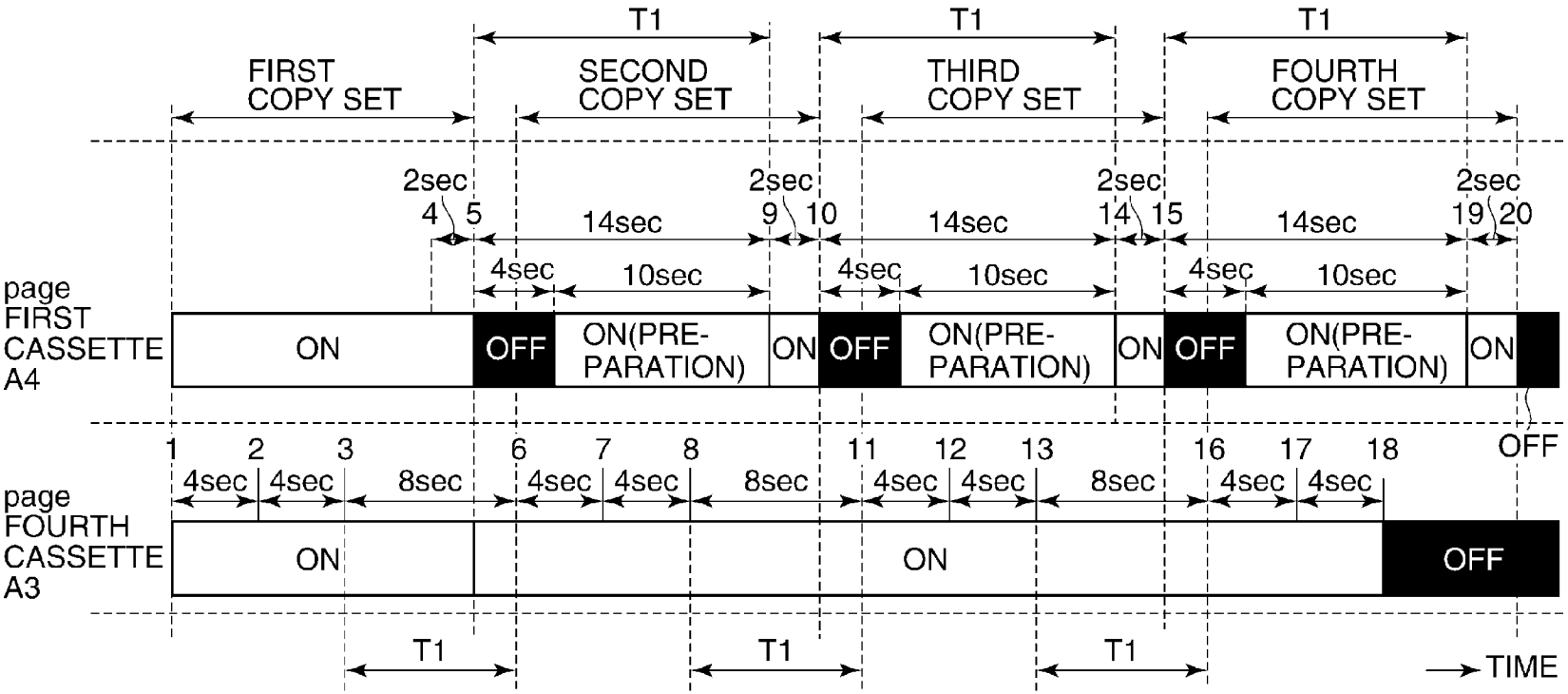
FIG. 7 is a timing chart showing sheet feeding suspension time periods and fan driving conditions.

FIG. 7 is a timing chart showing sheet feeding suspension time periods and fan driving conditions. When all originals have been read, and a sheet feeding order for printing of the first copy set has been determined, the subsequent sheet feeding orders are repetitions corresponding to a set number of copies (in the present embodiment, a value of 4), and hence all sheet feeding suspension time periods in the job can be determined.

Namely, when sheets up to the sheet feeding order 5 in the first copy set have been determined, the sheet feeding suspension time period from a sheet feeding order 6 to a sheet feeding order 20 is automatically determined. When the sheet feeding suspension time period T1 is longer than the preparation time period T2 required to prepare for fan drive (the preparation time until the fans are brought into a required driving state), fan drive can be suspended.

In the case of the sheet feeding cassette 1, there is the sheet feeding suspension time period T1 of 14 seconds from when a sheet in the sheet feeding order 5 is fed to when a sheet in the sheet feeding order 9 is fed, fan drive can be suspended (OFF) in this timing. However, because the preparation time period T2 required to prepare for fan drive again so as to feed the sheet in the sheet feeding order 9 is 10 seconds, fan drive is started again 4 seconds after fan drive is suspended (OFF).

Similarly, the sheet feeding suspension time period T1 from the sheet feeding order 10 to the sheet feeding order 14, and the sheet feeding suspension time period T1 from the sheet feeding order 15 to the sheet feeding order 19 are also 14 seconds, and hence fan drive can be suspended in each sheet feeding suspension time period T1.

On the other hand, in the case of the sheet feeding cassette 4, because the sheet feeding suspension time period T1 is never longer than the preparation time period T2, fan drive cannot be suspended in the sheet feeding suspension time period. Moreover, because it is known that in the sheet feeding cassette 1, a sheet in the sheet feeding order 20 is the last sheet to be fed, and on the other hand, in the sheet feeding cassette 4, a sheet in a sheet feeding order 18 is the last sheet to be fed, fan drive is not required after that in both cases. Thus, fan drive is stopped immediately after each sheet is fed.

Figure 8:
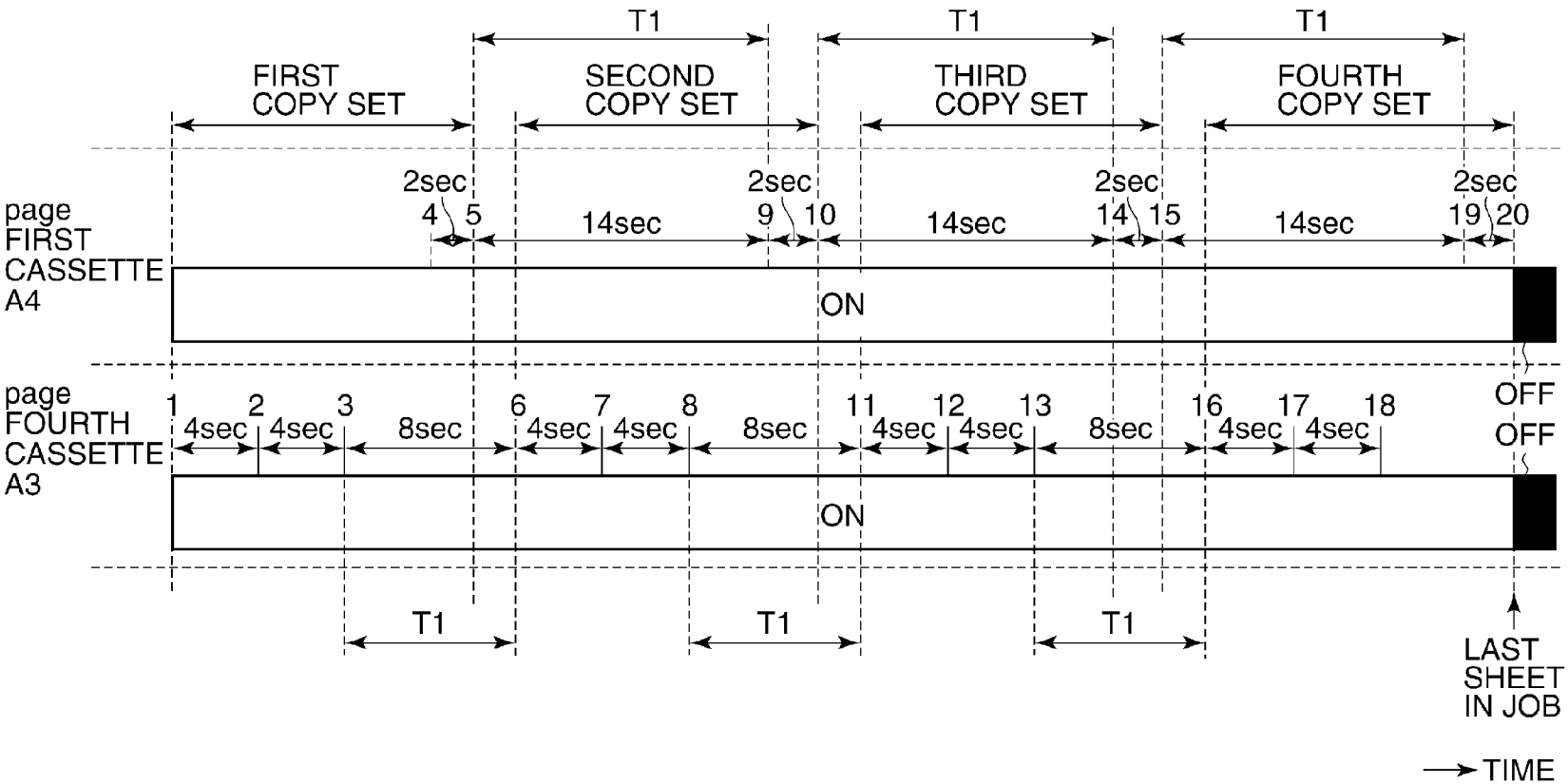
FIG.8 PRIOR ART
FIG. 8 is a timing chart showing sheet feeding suspension time periods and fan driving conditions in a case where fan drive is not positively stopped.

Here, for comparison, a description will be given of a case where fan drive is not positively stopped as in the prior art. FIG. 8 is a timing chart showing sheet feeding suspension time periods and fan driving conditions in a case where fan drive is not positively stopped. In this case, as distinct from the sheet feeding suspension time periods and the fan driving conditions shown in FIG. 7, even when reading of all originals has been completed, and a sheet feeding order for the first copy set has been determined, a sheet feeding suspension time period until the last page in each sheet feeding cassette is fed is not determined based on the sheet feeding order for the first copy set. For this reason, fan drive cannot be suspended effectively, and once fan drive is started, fan drive is continued unless the last page in a job is fed, and it is determined that no sheets will be fed subsequently. This is inconvenient in terms of power consumption, or in terms of sheet degradation caused by drying.

Figure 9:
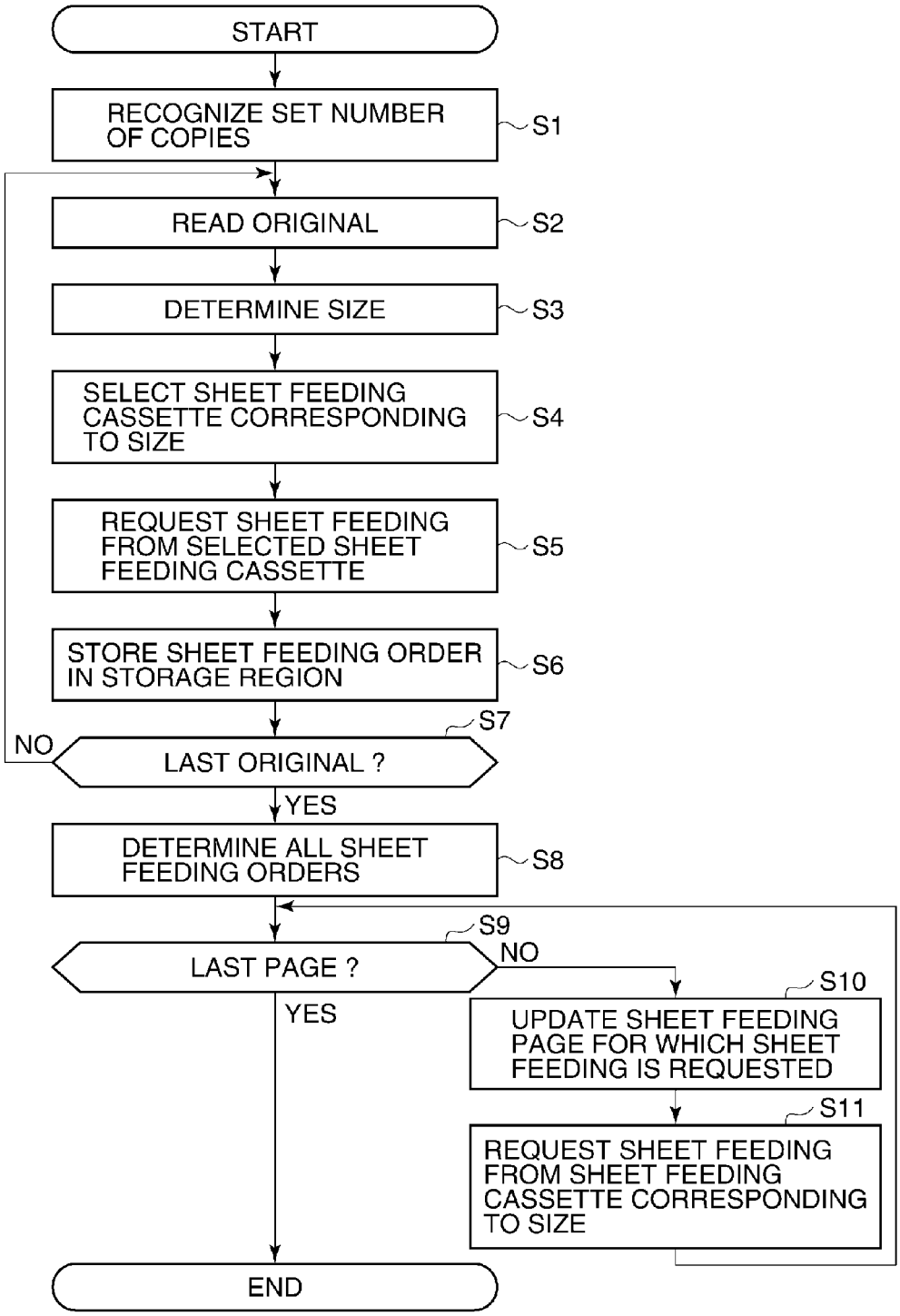
FIG. 9 is a flowchart of a sheet feeding request control procedure.

Next, a description will be given of how sheet feeding is controlled in the image forming apparatus. FIG. 9 is a flowchart of a sheet feeding request control procedure. This control program is stored in the ROM 601 in the CPU circuit unit 605, and executed by the CPU 600 in the CPU circuit unit 605.

The user places an original on the original feeder 100, sets a desired number of copies (a set number of copies) via the operation display unit 400, and starts a copying operation.

When an instruction to start a copying operation is issued via the operation display unit controller 641, the CPU circuit unit 605 recognizes (obtains) a set number of copies for a job, and stores the same in the RAM 602 (step S1). The process in the step S1 is an exemplary number-of-copies obtaining unit. The CPU circuit unit 605 instructs the original feeder controller 611 to feed the original, and instructs the image reader controller 621 to read the fed original (step S2). In accordance with the instructions, the original feeder 100 feeds the original, and the image reader 200 reads the fed original.

After that, the CPU circuit unit 605 determines an original size of the read original (step S3), and selects a sheet feeding cassette matching the determined original size (step S4).

Then, the CPU circuit unit 605 issues a sheet feeding request to the air sheet feeding controller 651 so that sheets can be fed from the sheet feeding cassette selected in the step S4 (step S5), and stores a sheet feeding order thereof in the sheet feeding order storage region in the RAM 602 (step S6).

The CPU circuit unit 605 determines whether or not the original read this time is the last original (step S7). When the original read this time is not the last original, there is still an original that should be read, and hence the CPU circuit unit 605 returns to the process in the step S2 to read the next original. Thus, until it is determined in the step S7 that the read original is the last original, the CPU circuit unit 605 repeatedly carries out the processes from the step S2 to the step S6. In this way, reading of all originals, selection of sheet feeding cassettes for the respective originals, storage of sheet feeding orders, and issuance of sheet feeding requests are carried out.

On the other hand, when it is determined in the step S7 that the read original is the last original, the CPU circuit unit 605 determines a sheet feeding order for all sheets based on the set number of copies for the job recognized in the step S1 and the sheet feeding orders of the originals in the first copy set stored in the step S6 (step S8).

As described earlier with reference to FIGS. 5A to 5C and FIG. 6A to 6D, once a sheet feeding order for the first copy set has been determined, subsequent sheet feeding orders are repetitions of the same sheet feeding order corresponding to a set number of copies (a value of 4 in the present embodiment), and hence a sheet feeding order for all sheets can be determined. Thus, the sheet feeding order for all sheets determined in the step S8 is stored in the sheet feeding order storage region in the RAM 602.

The CPU circuit unit 605 determines whether or not sheet feeding requests for all pages have been issued to the air sheet feeding controller 651 according to the sheet feeding order determined in the step S8 (step S9). When it is determined that a sheet feeding request for the last page has been issued, the CPU circuit unit 605 terminates the present sheet feeding request control.

On the other hand, when it is determined in the step S9 that a sheet feeding request for the last page has not yet been issued, the CPU circuit unit 605 updates a sheet feeding page for which a sheet feeding request is to be issued next (step S10), and issues a sheet feeding request to the air sheet feeding controller 651 to feed a sheet from a sheet feeding cassette corresponding to the updated sheet feeding page (step S11).

After issuing this sheet feeding request, the CPU circuit unit 605 returns to the process in the step S9. Then, the CPU circuit unit 605 repeatedly carries out the processes in the steps S10 and S11 until a sheet feeding request for the last page is issued.

Figure 10:
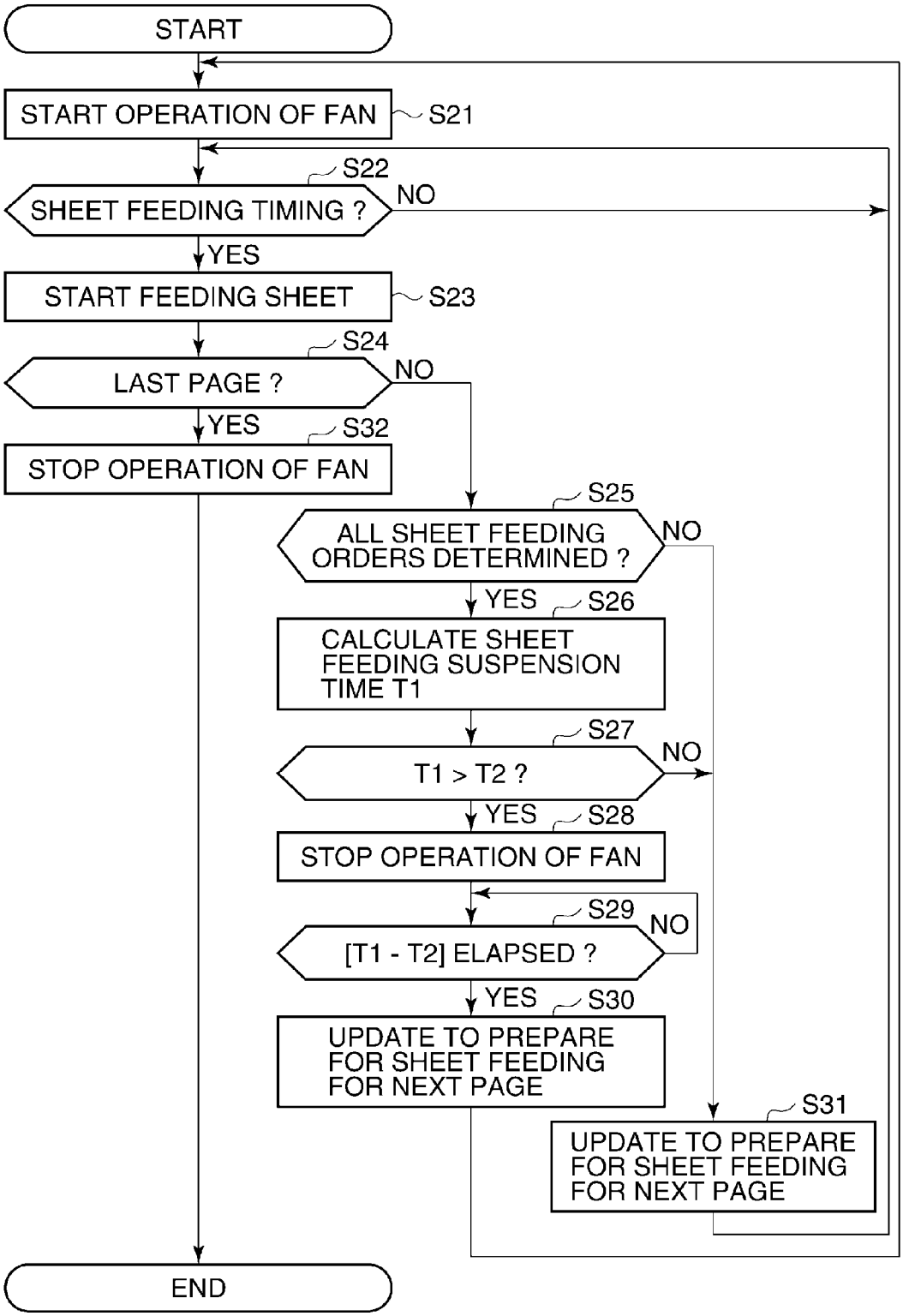
FIG. 10 is a flowchart of a sheet feeding control procedure.

FIG. 10 is a flowchart of a sheet feeding control procedure. This control program is stored in the ROM 601 in the CPU circuit unit 605, and executed by the CPU 600 in the CPU circuit unit 605. The CPU circuit unit 605 acts as a control unit by executing step processes as described below.

First, the CPU circuit unit 605 instructs the air sheet feeding controller 651 to start fan drive for air sheet feeding (step S21). In response to the instruction from the CPU circuit unit 605, the air sheet feeding controller 651 starts fan drive for air sheet feeding and prepare for the air sheet feeding. The CPU circuit unit 605 waits for sheet feeding timing (step S22), and at sheet feeding time, the CPU circuit unit 605 instructs the air sheet feeding controller 651 to start sheet feeding (step S23). In accordance with the instruction, the air sheet feeding controller 651 starts sheet feeding. The CPU circuit unit 605 determines whether or not a sheet fed this time is the last sheet to be fed in a sheet feeding cassette therefor (step S24). When a sheet fed this time is the last sheet to be fed in a sheet feeding cassette therefor, the CPU circuit unit 605 instructs the air sheet feeding controller 651 to stop fan drive after the last sheet is fed (step S32). In accordance with the instruction to stop fan drive, the air sheet feeding controller 651 stops fan drive. After that, the CPU circuit unit 605 terminates the present sheet feeding control.

On other hand, when it is determined in the step S24 that a sheet fed this time is not the last sheet to be fed in a sheet feeding cassette therefor, there is still a sheet that should be fed subsequently, and hence the CPU circuit unit 605 proceeds to a process in step S25. Specifically, the CPU circuit unit 605 determines whether or not a sheet feeding order for all sheets has already been determined in the sheet feeding request control described above with reference to FIG. 9 (step S25).

When a sheet feeding order for all sheets has not yet been determined, it can be determined that a sheet feeding order for the entire job has not been determined because reading of originals is still under way, and hence fan drive cannot be stopped. Thus, it is unnecessary to determine whether or not to stop fan drive, and the CPU circuit unit 605 continues fan drive, and updates the page so as to prepare for sheet feeding for the next page (step S31). After that, the CPU circuit unit 605 returns to the process in the step S22 to wait for the next sheet feeding timing. Thus, fan drive is continued during image formation for the first copy set.

On other hand, when it is determined in the step S25 that a sheet feeding order for all sheets has been determined, the CPU circuit unit 605 calculates the sheet feeding suspension time period T1 based on the determined sheet feeding order as described above (step S26). The CPU circuit unit 605 compares the calculated sheet feeding suspension time period T1 with the preparation time period T2 required to prepare for fan drive (step S27). When the sheet feeding suspension time period T1 is longer than the preparation time period T2, it is determined that fan drive can be stopped, and hence the CPU circuit unit 605 instructs the air sheet feeding controller 651 to stop fan drive (step S28). In accordance with the instruction, the air sheet feeding controller 651 stops fan drive.

As described above, in order to perform control such that after a sheet is fed from a first sheet feeding unit, a sheet is fed from a second sheet feeding unit, and then a sheet is fed from the first sheet feeding unit again without degrading productivity, fan drive must be started the preparation time T2 (10 seconds) in advance of sheet feeding resumption timing. For this reason, the CPU circuit unit 605 ascertains that the above described time period (T2−1) has elapsed since fan drive was stopped in the step S28 (step S29). Upon ascertaining the lapse of this time period, the CPU circuit unit 605 immediately updates the page so as to prepare for resuming sheet feeding (step S30). After that, the CPU circuit unit 605 returns to the process in the step S21 in which it instructs the air sheet feeding controller 651 to resume fan drive. It should be noted that although in the present embodiment, fan drive is resumed after the lapse of the time period (T2−T1), fan drive may be resumed the preparation time period or longer (the preparation period or longer) in advance of sheet feeding resumption timing. In this case, fan drive can be started with sufficient lead time.

On other hand, when it is determined in the step S27 that the sheet feeding suspension time period T1 is shorter than the preparation time T2 required to prepare for fan drive, it is determined that fan drive cannot be stopped without degrading productivity. Thus, the CPU circuit unit 605 causes the air sheet feeding controller 651 to continue fan drive without instructing the air sheet feeding controller 651 to stop fan drive, and proceeds to a process in step S31. Then, the CPU circuit unit 605 updates the page so as to prepare for feeding a sheet for the next page, and returns to the process in the step S22 to wait for the next sheet feeding timing.

It should be noted that when the sheet feeding suspension time period T1 and the preparation time T2 are compared with each other in the step S27, an arbitrary time unit may be used for a difference between them. For example, they may be compared with each other in seconds, or using an arbitrary time unit such as 0.5 seconds or 2 seconds As described above, the image forming apparatus according to the present embodiment stores a sheet feeding order for the first copy set, determines sheet feeding suspension time periods for respective sheet feeding cassettes, and determines whether or not to stop fan drive without degrading productivity, so that fan drive can be effectively suspended and resumed. Also, after a sheet for the last page in each sheet feeding cassette is fed, fan drive is immediately stopped. This enables prevention of reduction in useful lives of the fans, reduction of noise caused by the fans, reduction of power consumption, prevention of sheet degradation caused by drying, and so on. Moreover, the same control can be provided not only when copying originals, but also when executing a print job sent from a computer.

Moreover, when images are to be formed using a plurality of sheet feeding cassettes in one job, for example, in a case where sheets of different sizes are stacked, fan drive can be positively stopped without bringing about throughput degradation.

Moreover, because after a sheet feeding order for the first copy set is stored, the sheet feeding suspension time periods are determined for respective sheet feeding cassettes according to the number of copies, a sheet feeding order can be automatically determined without the need to input a sheet feeding order in advance, which results in enhancement of operability. Moreover, because fan drive is resumed after a lapse of a time period obtained by subtracting a preparation time period from a sheet feeding suspension time period, the maximum suspension time period can be ensured.

Moreover, in a case where a sheet feeding suspension time period is not less than a predetermined time period longer as compared to a preparation time period, fan drive may be suspended, and in this case, the air sheet feeding mechanism can be activated with sufficient lead time to resume sheet feeding, and sheet feeding can be resumed without bringing about throughput degradation.

Moreover, when it is determined during an image forming operation that no sheet will fed from a sheet feeding cassette, fan drive for this sheet feeding cassette may be immediately stopped, and in this case, fan drive can be more positively stopped without bringing about throughput degradation.

It should be noted that the present invention is not limited to the arrangement of the above described embodiment, but the present invention may be applied to any arrangements as long as they can realize the functions defined in the scope of claims or the functions which the arrangement of the present embodiment has.

For example, although in the embodiment described above, the air sheet feeder using the fans is used as an exemplary sheet feeder, the present invention may be applied to a sheet feeder using any other sheet feeding method.

Moreover, although in the embodiment described above, a sheet feeding order is determined by feeding sheets for the first copy set and performing an image forming operation, the user may determine a sheet feeding order by inputting this from an operation panel. In this case, suspension and resumption of the fans can be controlled from the first copy set. Moreover, a sheet feeding order may be determined by performing only a sheet feeding operation in advance according to a job without performing an image forming operation, and thereafter, an image forming operation may be performed for the set, which can obtain the same effects.

Although in the embodiment described above, the electrophotographic method is taken as an example of the printing method which the image forming apparatus uses, the present invention is not limited to the electrophotographic method, but may be applied to various printing methods such as an inkjet printing method, a thermal transfer printing method, a direct thermal printing method, an electrostatic printing method, and a discharge breakdown printing method.

Moreover, materials of sheets to be fed are not particularly limited, but sheet media, OHP sheets, cardboard sheets, and so on may be used. Also, forms of sheets are not particularly limited, but tab sheets and others may be used.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-011122 filed Jan. 21, 2010, which is hereby incorporated by reference herein in its entirety.

What is claimed is:

1. An image forming apparatus comprising:

an image forming unit configured to form an image on a sheet;

a first sheet supply unit configured to store a plurality of sheets, supply the sheets one by one to said image forming unit, and have a fan that is driven so as to supply the sheets;

a second sheet supply unit configured to store a plurality of sheets, and supply the sheets one by one to said image forming unit; and a control unit configured to, when a sheet is fed from said first sheet supply unit, then a sheet is supplied from said second sheet supply unit, and then a sheet is supplied form said first sheet supply unit again, in a case where a suspension time period over which no sheet is supplied from said first sheet supply unit is longer than a preparation time period from starting a driving of the fan to becoming a driving state required to supply a sheet, temporarily stop driving of the fan in the suspension time period.

2. An image forming apparatus according to claim 1, wherein said control unit resumes driving of the fan, of which driving has been suspended, no later than the preparation time period prior to a time at which said first sheet supply unit which has suspended sheet supply resumes sheet supply.

3. An image forming apparatus according to claim 2, wherein said control unit resumes driving of the fan after a lapse of a time period obtained by subtracting the preparation time period from the suspension time period since a sheet is supplied from said second sheet supply unit.

4. An image forming apparatus according to claim 1, wherein said control unit stops driving of the fan provided in said first sheet supply unit after a sheet is supplied from said first sheet supply unit in a case where a sheet is supplied from said first sheet supply unit, then a sheet is supplied from said second sheet supply unit, and a sheet is not supplied from said first sheet supply unit again.

5. An image forming apparatus according to claim 1, wherein said first sheet supply unit comprises a tray on which the sheets can be placed, a conveying belt that conveys the sheets;

an air jetting unit that has a first fan that blows air to the sheets placed on said tray, and separates an uppermost sheet from a stack of the sheets placed—on the tray; and an air suction unit that has a second fan that attracts the uppermost sheet to the conveying belt, and supplies the sheet attracted to said conveying belt.

6. A sheet feeding apparatus that supplies a sheet to an image forming apparatus that forms an image on a sheet;

a first sheet supply unit configured to store a plurality of sheets, supply the sheets one by one to an image forming unit, and have a fan that is driven so as to supply the sheets;

a second sheet supply unit configured to store a plurality of sheets, and supply the sheets one by one to the image forming unit; and a control unit configured to, when a sheet is supplied from said first sheet supply unit, then a sheet is supplied from said second sheet supply unit, and then a sheet is supplied from said first sheet supply unit again, in a case where a suspension time period over which no sheet is supplied from said first sheet supply unit is longer than a preparation time period from starting a driving of the fan to becoming a driving state required to supply a sheet, temporarily stop driving of the fan.

7. An image forming apparatus comprising:

an image forming unit configured to form an image on a sheet;

a first sheet supply unit configured to store a plurality of sheets, supply the sheets one by one to said image forming unit, and have a fan that is driven so as to supply the sheets;

a second sheet supply unit configured to store a plurality of sheets, and supply the sheets one by one to said image forming unit;

an obtaining unit configured to obtain a sheet supply order in which sheets are supplied from said first sheet supply unit and said second sheet supply unit; and a control unit configured to control driving and stop of the fan based on the sheet supply order obtained by said obtaining unit, wherein said control unit obtains a time period equivalent to a suspension time period from stopping a supply of a sheet from said first sheet supply unit to starting a supply of a next sheet from said first sheet supply unit, and in a case where the time period equivalent to the suspension time period is longer than a preparation time period from starting a driving of the fan to becoming a driving state required to supply a sheet, temporarily stops driving of the fan in the suspension time period, and at a time that goes back the preparation time from a time at which a sheet is supplied from said first sheet supply unit, resumes driving of the fan.

8. An image forming apparatus according to claim 7, wherein said control unit resumes driving of the fan after a lapse of a time period obtained by subtracting the preparation time period from the suspension time period since a sheet is supplied from said second sheet supply unit.

9. An image forming apparatus according to claim 8, wherein said control unit stops driving of the fan provided in said first sheet supply unit in the suspension time period after a sheet is supplied from said first sheet supply unit in a case where a sheet is supplied from said first sheet supply unit, then a sheet is supplied from said second sheet supply unit, and a sheet is not supplied from said first sheet supply unit again.

10. An image forming apparatus according to claim 7, wherein said first sheet supply unit comprises a tray on which the sheets can be placed—, a conveying belt that conveys the sheets;

an air jetting unit that has a first fan that blows air to the sheets placed—on said tray, and separates an uppermost sheet from a stack of the sheets placed on the tray; and an air suction unit that has a second fan that attracts the uppermost sheet to the conveying belt, and supplies the sheet attracted to the conveying belt.

11. A sheet feeding apparatus that supplies a sheet to an image forming apparatus that forms an image on the sheet, comprising:

a first sheet supply unit configured to store a plurality of sheets, supply the sheets one by one to an image forming unit, and have a fan that is driven so as to supply the sheets;

a second sheet supply unit configured to store a plurality of sheets, and supply the sheets one by one to the image forming unit;

an obtaining unit configured to obtain a sheet supply order in which sheets are supplied from said first sheet supply unit and said second sheet supply unit; and a control unit configured to control operation and stop of the fan based on the sheet supply order obtained by said obtaining unit, wherein said control unit obtains a time period equivalent to a suspension time period from stopping supply of a sheet from said first sheet supply unit to when starting supply a next sheet from said first sheet supply unit, and in a case where the time period equivalent to the suspension time period is longer than a preparation time period from starting a driving of the fan to becoming a driving state required to supply a sheet, temporarily stops driving of the fan in the suspension time period, and at a time that goes back the preparation time from a time at which a sheet is supplied from said first sheet supply unit, resumes driving of the fan.

* * * * *